United States Patent [19]

Banks

[11] Patent Number: 4,827,698

[45] Date of Patent: May 9, 1989

[54] PACKAGING WEIGHT CONTROL SYSTEM

[75] Inventor: Charles K. Banks, Roseland, N.J.

[73] Assignee: Nabisco Brands, Inc., Parsippany, N.J.

[21] Appl. No.: 163,706

[22] Filed: Mar. 3, 1988

[51] Int. Cl.[4] ..... B65B 5/10; B65B 65/08; B65B 1/32; B65B 1/36

[52] U.S. Cl. ..... 53/443; 53/502; 53/504; 53/461

[58] Field of Search ..... 53/443, 461, 502, 504, 53/154, 532, 203, 449, 171

[56] References Cited

U.S. PATENT DOCUMENTS

| | | | |
|---|---|---|---|
| 2,470,916 | 5/1949 | Carruthers . | |
| 3,557,889 | 1/1971 | Rejsa . | |
| 3,708,025 | 1/1973 | Soler et al . | |
| 3,846,957 | 11/1974 | Divan | 53/502 |
| 3,939,928 | 2/1976 | Murakami et al. . | |
| 4,024,381 | 5/1977 | Fluck . | |
| 4,122,941 | 10/1978 | Giles et al. . | |
| 4,136,504 | 1/1979 | Wyslotsky | 53/504 X |
| 4,141,442 | 2/1979 | Cole et al. | 53/502 X |
| 4,164,260 | 8/1979 | Blodgett . | |
| 4,209,960 | 7/1980 | Deutschlander et al. | 53/504 X |
| 4,398,613 | 8/1983 | Hirano . | |
| 4,537,229 | 8/1985 | Sashiki et al. . | |
| 4,538,693 | 9/1985 | Kolpfenstein et al. . | |
| 4,545,179 | 10/1985 | Rebsamen et al. | 53/502 X |
| 4,730,438 | 3/1985 | Koutonen | 53/504 X |

*Primary Examiner*—Horace M. Culver
*Attorney, Agent, or Firm*—Richard Kornutik

[57] ABSTRACT

The packaging system consists of a method for packaging a particular weight of pre-wrapped items. A measured length of articles to be packaged is fed to a wrapping station. The measured length of articles is then wrapped to form a wrapped stack of the articles called a slug pack and the slug pack is weighed. The weighted slug pack is then sent to a classifying accumulator which inventories a number of the slug packs of known weight. A set number of slug packs having a combined weight above a preset minimum and a preset maximum weight is then selected and packaged together. The apparatus used in the system comprises a length metering feeder having a multiple number of lanes to hold a measured length of articles to be wrapped, an apparatus to wrap the measured length of articles and a device for weighing and recording the weight of each slug pack. A device for categorizing, counting and storing the slug packs in an accumulation system. The weighed slug packs are then held in a classifying accumulator and selected from the classifying accumulator by weight for packaging. The classifying accumulator has the means to channel and inventory the slug packs into the appropriate weight categories and select the slug packs by weight using the computer-integrated manufacturing controls. A specified number of slug packs are combined and packaged to meet a desired final package weight. A signal is sent to the loader to adjust the measured length of articles that are wrapped to form the slug packs providing the proper distribution of weight selection categories in the accumulator.

32 Claims, 3 Drawing Sheets

PACKAGING WEIGHT CONTROL SYSTEM

BACKGROUND OF THE INVENTION

This invention relates to a method and system for controlling the final package weight of slug pack products using a computer-integrated control system. More particularly, this computer-integrated control system consists of the filing of the slug pack weights into a data storage and retrieval system for selection and final grouping of slug packs to form a final package weight. A designated number of slug packs, also sometimes known as stacks, is then selected for final packaging according to the individual slug pack weights combined to yield a final package within the desired weight range. If the slug packs are determined to be significantly underweight, or significantly overweight, a signal is sent to the length metering feeder whereby the number of articles to be wrapped in the slug pack is either increased or decreased in order to produce stacks having a weight falling within the desired range.

In many instances a package must contain a certain weight of product in order for it to meet various consumer protection laws. This is particularly the case with regard to foods such as crackers, cookies and similar items. It is always safe to put into each package a number of articles so that the packages will definitely meet the minimum weight requirement. However, when this is done, the producer is giving away, at no cost, a certain amount of the product. This may not seem to be significant when one, two or three extra crackers, cookies or similar items are put into each package in order to assure that the minimum weight is met. However, when it is considered that the manufacturer will produce several million packaged units, the inclusion of two or three extra items into each package results in the giving away, for free, several million of the individual food items. Consequently, it is the objective of each producer to meet the minimum weight requirement, but also not to significantly exceed this minimum weight requirement. In this regard various systems and equipment have been developed so that the items can be automatically packaged, the minimum weight requirement met, but the weight of each package not exceeding the minimum by more than a de minimis amount.

Automatic systems have been developed to produce packages having a final target weight. In U.S. Pat. No. 2,470,916 tuna fish is packaged into cans according to the weight of each piece of fish. The person doing the packing has a final target weight that must be met. Pieces of tuna fish of known weight are then chosen by the packer so that this final target weight can be met, but in a way that the target weight is not significantly exceeded.

In U.S. Pat. No. 3,939,928 varying numbers of items to be packaged are flowed to a set number of hoppers. The items in each hopper are then weighed. Knowing the weight of the items in each hopper and knowing the final target weight desired, the hoppers are chosen to fill a package so that the final weight of the items is above, but yet very close to, the target weight.

In U.S. Pat. No. 4,024,381 the objective is to have a certain number of biscuits or cookies packaged within a container. In order to accomplish this objective the items are conveyed to any one of a number of parallel-arranged counting channels. If the number of cookies within a counting channel is correct, the items in that channel are forwarded on for packaging or for stacking in combination with other items.

U.S. Pat. No. 4,545,179 is also directed to the packaging of cookies and similar items. In this patent a certain number of cookies are counted for packaging. This is accomplished by knowing the length of the desired number of cookies. If the cookies in various channels are of the correct length, they are then passed for packaging. If the number is not of the correct length, then the cookies are sent to a waste slot.

U.S. Pat. No. 4,164,260 discloses a method and apparatus for determining minimum and average weights prior to packaging so as to assure that no units are below a given minimum weight. If necessary, more of a product is added to a unit if it is below a desired minimum. If the deviation from the average weight is not acceptable, an alarm may be energized and the system shut down. Accumulators are used to store the new signals and the old signals. The signals are added algebraically to produce an output in accordance with total net deviation from the average. However, like the other references all processing is performed on a product prior to wrapping and packaging.

U.S. Pat. No. 4,398,229 discloses a device which is stated to be useful in packing articles such as cakes and candies in bags so that each package contains a set number of articles. This device is concerned with packing a certain number of articles and the final weight is not a concern.

In U.S. Pat. 4,537,229 there is disclosed an automatic weighing apparatus wherein two variables are sensed so that not only will the package have the proper weight, but also the correct volume. The two variables are weight and apparent specific gravity. Specific gravity is determined as a function of pressure by means of a pressure sensor. Foods such as potato chips and flaked cereals are mentioned as being suitable for packaging. In this technique there is no concern with regard to the number of articles packaged and all processing is prior to product wrapping.

U.S. Pat. 4,538,693 discloses a weighing apparatus. The product to be packaged is segregated into discrete quantities which are combined into a group that closely approximates a target weight. The product is then received by a number of discrete holding chambers. The weight in each holding chamber is known. A container is filled from the correct selection of chambers to get a desired total weight. However, as above noted, the articles are not pre-wrapped and all steps are conducted prior to any wrapping or packaging.

In U.S. Pat. No. 4,209,960 there is disclosed an apparatus for maintaining a constant weight of article stacks. A stack of cookies is produced by two stack forming devices' The cookies are received by the stack formers from a first conveyor. A second conveyor conveys the stacks away from the stack formers to a weighing machine and then on for packing in a carton. The weighing machine is connected electronically to the stack formers so that the length of the stack can be varied as a function of the stack weight. However, there is no wrapping of the stacks and then combining of the wrapped stacks by weight into a final package.

U.S. Pat. No. 3,557,889 discloses a process and apparatus for filling packages with granular or fluid material. A package is filled to an amount less than the desired weight. Product is added to the package from one or more hoppers containing a known weight of product until there is no weight deficiency.

U.S. Pat. No. 3,708,025 discloses a similar method and apparatus. The articles, such as oranges, are weighed and classified as to weight. A plurality of feeding channels deliver a set number of the weighed oranges to the end package in a manner so that a certain target weight is achieved.

U.S. Pat. No. 4,122,941 also discloses a similar method and but directed to the packaging of fish fillets. The fish fillets are fed onto weighing platforms. A computer knows the desired target weight and takes the fillets from the particular weight platforms in order to best meet the target weight. These fish fillets are then packaged. However here, as in U.S. Pat. No. 3,708,025 and U.S. Pat. No. 3,557,889, there is no forming of wrapped article stacks and then packaging chosen stacks in order to reach a desired target weight for the end package.

There are yet various other techniques for packaging items in order to meet a minimum weight requirement. However, none of these systems is directed to a technique where items such as cookies or crackers are prewrapped into stacks, the stacks weighed, and then the stacks chosen for final package in order to meet a minimum weight requirement but yet not to unduly exceed this weight requirement. Also not used by others is the technique whereby if the wrapped stacks do not meet a desired weight then the length of the grouping of cookies or crackers incorporated to produce each stack is changed. These stacks are then forwarded for subsequent selecting and combining of stacks. In this way, overweights are reduced and the weight requirements are met.

SUMMARY OF THE INVENTION

The present invention comprises a method and apparatus for packaging discrete articles such as cookies, crackers, biscuits and the like. Methods of stacking, loading, wrapping and weighing cracker and biscuit stacks are known. The present method and apparatus provides a unique computer-integrated control system for controlling, classifying, selecting and grouping wrapped stacks of articles, known as slug packs, into a final package which has certain weight requirements. The method for packaging the articles comprises selecting a measured length of articles, feeding the measured length of the articles to a wrapping station, wrapping the articles to form a slug pack of the wrapped articles, determining the weight of each slug pack, filing and storing the weight of each slug pack in a computer-based storage and retrieval system, and conveying each slug pack into the appropriate weight category of a classifying accumulator in accordance with this stored weight data. The selecting of the slug packs from the classifying accumulator is based on the stored weight data and is such that the selected slug packs have a combined weight which is within a designated weight range. A balanced weight distribution of slug packs is maintained in the classifying accumulator by the computer-integrated control system in order to achieve the final weight range. This is accomplished by a continually registered weight signal being sent, via the computer-integrated control system, to the length metering feeder to either increase or decrease the number of articles selected to be wrapped. This control produces a balanced distribution of slug packs that are within the weight ranges required to correct and maintain a balanced distribution of slug packs in the various categories inventoried in the accumulator.

The apparatus of the invention includes a length metering feeder which has multiple lanes to accept and hold articles that are to be wrapped. The length metering feeder selects the measured length of such articles for feeding into wrapping equipment to wrap each selected group of articles into slug packs. The wrapper feeds the slug packs to a weighing device to determine the weight of each slug pack of wrapped articles. From the weighing device the slug packs are fed via a diverger, and based on the weight data, to a classifying accumulator to hold the slug packs. Optionally, prior to the diverger there can be a metal detector. The slug packs are held in the accumulator in separate channels based on slug pack weights. The accumulator has the means to inventory the slug packs in the various channels. A slug pack selector selects the slug packs to be packaged by slug pack weight using the computer-integrated system. A specified number of selected slug packs are then combined and packaged into a carton to meet a final package weight. In the event that the inventoried slug packs in the classifying accumulator do not provide a balanced weight distribution of slug packs to form combinations meeting the desired final weight, a signal is sent to the length metering feeder from the computer-integrated control system whereby the measured length of the stacked articles in designated lanes of the length metering feeder that is selected is either increased or decreased to meet the desired weight distribution requirements of slug packs in the classifying accumulator. The slug packs are then placed in a carton and forwarded to a checkweigher. The equipment to produce the final package comprises cartoning equipment which has input into, and is controlled by, the computer integrated control system. The slug packs maintain the food items in a fresh state rather than having all of the items exposed to the atmosphere when the package is first opened and also serve to maintain the integrity of the food item during handling.

DETAILED DESCRIPTION

As has been noted above, it is preferred with many food items, in order to maintain freshness, to package the items in smaller quantities, which in turn are then contained in a larger carton. This is particularly the case with regard to cookies, crackers and biscuits. This does, however, present some problems with regard to the overall weight of the final package. The weight of the wrappings of the individual slug packs of articles must be subtracted as well as there must be a close control of the weight of the articles within each slug pack. Whereas in most instances a manufacturer is solely concerned about the final weight of the articles put into a package, in the present case there has to be a concern with regard to the weight of each slug pack as well as with regard to the weight of the final overall carton.

Figure 1:
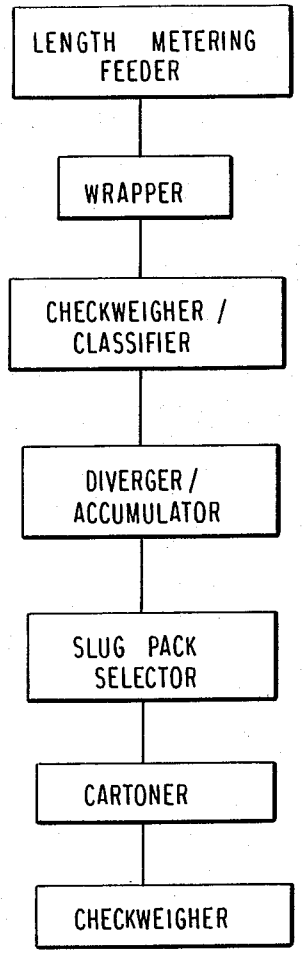
FIG. 1 is a block diagram description of the packaging sequence.

FIG. 1 sets out in block diagram form the general packaging sequence that is followed in the present process. The items to be packaged are first sent to a length metering feeder. The feeder part of the length metering feeder usually consists of a number of lanes which accept the items to be wrapped. The lanes can range from approximately 4 to 12 or more. The metering section will usually consist of a pre-set or a servo-motor controlled arm that takes a certain length of articles from a lane. The chosen length of articles, is sent to a wrapper where the articles are wrapped with a plastic laminate or coextruded film, a cellophane or a waxed paper to form slug packs of articles having a shape similar to that of the individual articles that are wrapped. From the wrapper, this wrapped slug pack is sent to a weigh station. Optionally, after wrapping, the slug pack can be passed through a metal detector. After weight determination each slug pack is categorized by weight and sent to a diverger which directs the slug packs to a channel of an accumulator where they are held until released for final packaging. In final packaging a number of the slug packs are selected and put into a final carton or package. The carton or package then may be passed through a checkweigher for a final weight determination. This checkweigher will discover large weight deviations, such as a slug pack not being placed into the carton or package. Such a carton or package would be rejected. Slug packs are selected from the classifying accumulator by the weight categories that produce at least a certain minimum final weight of product in the carton or package and which does not exceed this minimum weight except for a given tolerance. As an example, if four slug packs are to be incorporated into a final package, and two of the slug packs in the accumulator are underweight, and two of the slug packs are overweight by a similar or slightly greater increment, then these four slug packs could be combined since those which are overweight would cancel out those which are underweight. In this way, it is possible to use all of the slug packs that have been wrapped and not to significantly exceed the minimum weight. The objective is to select the slug packs to meet the final package weight requirements. The present process and apparatus is directed to optimizing the method for implementing and controlling the wrapping and packaging sequence. This is accomplished through an automated computer-integrated control system. This system receives input signals from the sensors monitoring the stack height of the shingled articles in the feeder lanes of the length metering feeder. These signals are used to monitor and control the flow rates in the feeder lanes. The computer-integrated control system receives an input from the checkweigher/classifier and records the slug pack weights. Based on this and other input, the computer-integrated control system will determine the inventory of the slug packs forwarded to the classifying accumulator, adjusting this inventory to maintain a balanced distribution of weight selection categories. This is accomplished by making adjustments in the measured length of articles chosen by the length metering feeder to be wrapped into a slug pack.

There is no requirement that any particular type of equipment be used. It is only necessary that the equipment be compatible for control by a computer system. Useful units of equipment are manufactured by many different manufacturers and are well known in the art. It is common to use computer controlled equipment in wrapping and packaging articles such as cookies, crackers and biscuits. There are numerous manufacturers of length metering feeders, wrappers' checkweighers, divergers, accumulators, cartoners and metal detectors whose equipment can be adapted for use in the packaging system. These satisfy the primary requirement that the equipment be compatible for computer-integrated control along with other units in the system. This will usually require an output signal which provides information on the operating status of the unit and a means to control the unit through one or more input signals. In the detailed design of the system each unit is made to interface with the other units of equipment. The computer programs assure that each unit of equipment will compatibly function with the other units of equipment. This is the case even through different units of equipment are supplied by different manufacturers.

For instance, the classifying accumulator channels can be designed where each slug pack will be segregated. The slug pack selector, upon the receipt of information from the computer-integrated control system, will cause a gate in certain channels to release the selected slug packs to be conveyed to packaging or cartoning. The remaining slug packs in these channels would then move forward and be in position for selection and packaging or cartoning during the next cycle of selecting slug packs. The operation of the gate in a channel can be one of the input signals to the computer-integrated control system whereby an inventory of slug packs in the channels of the classifying accumulator can be maintained.

Figure 2:
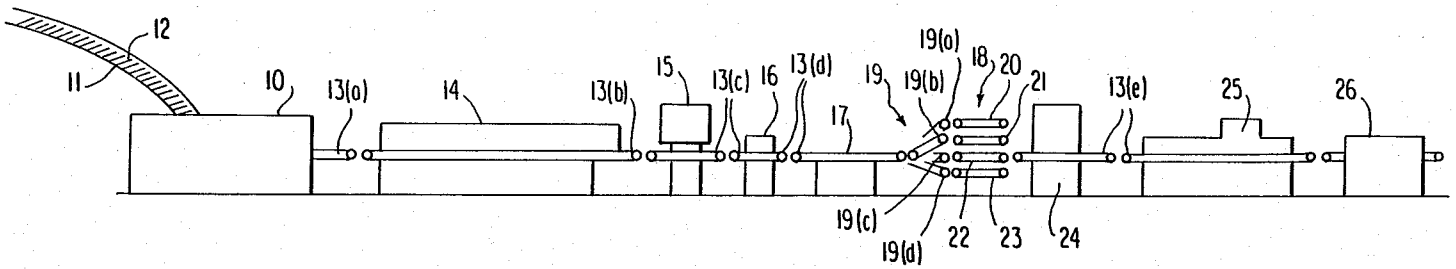
FIG. 2 is a general schematic elevational view of the equipment used in the packaging system.

FIG. 2 is an elevational schematic of the apparatus used to carry out the process using the units of equipment of FIG. 1 This apparatus consists of a number of units of equipment. Length metering feeder 10 receives articles 12 from lanes 11. The length metering feeder selects a certain length of articles and by means of conveyor 13(*a*) conveys these items to the wrapper 14. The wrapped articles, now called slug packs, are conveyed by conveyor 13(*b*) to the checkweigher/classifier 15. At this point the weight of the slug pack is determined and recorded using the present computer-integrated control system. The weighed slug packs are then optionally passed by conveyor 13(*c*) to a metal detector (16) in order to determine if any contaminating metal has gotten into the slug pack. This metal detector could also be placed before the checkweigher/classifier. The slug packs via conveyor 13(*d*) then go to the diverger 17. The diverger directs the slug pack to different channels of accumulator 18. As shown, diverger transfer unit 19 consists of four channels 19(*a*), 19(*b*), 19(*c*) and 19(*d*), which deliver each slug pack to one of accumulator channels 20, 21, 22 or 23. Four channels are shown for illustration purposes. Any appropriate number of accumulator channels can be used. The weight of the slug pack determines the accumulator channel to which a slug pack will be sent. The diverger receives the weight information from the computer integrated control system which, in turn, receives the information from the checkweigher/classifier. The accumulator 18 conveys each of the slug packs to the slug pack selector 24. The slug pack selector 24 then selects slug packs to meet a predetermined overall weight and delivers these slug packs via conveyor 13(*e*) to cartoner 25. The slug pack selector makes the selection based on information received from the computer-integrated control system. At this point, a set number of slug packs are put into a carton. The carton then moves by conveyor 13(*f*) to an optional checkweigher 26. This checkweigher would determine if any gross errors are present. Any cartons having gross errors would be removed from the packaging and investigated. An example of a gross error would be a carton not receiving the correct number of slug packs.

Figure 3:
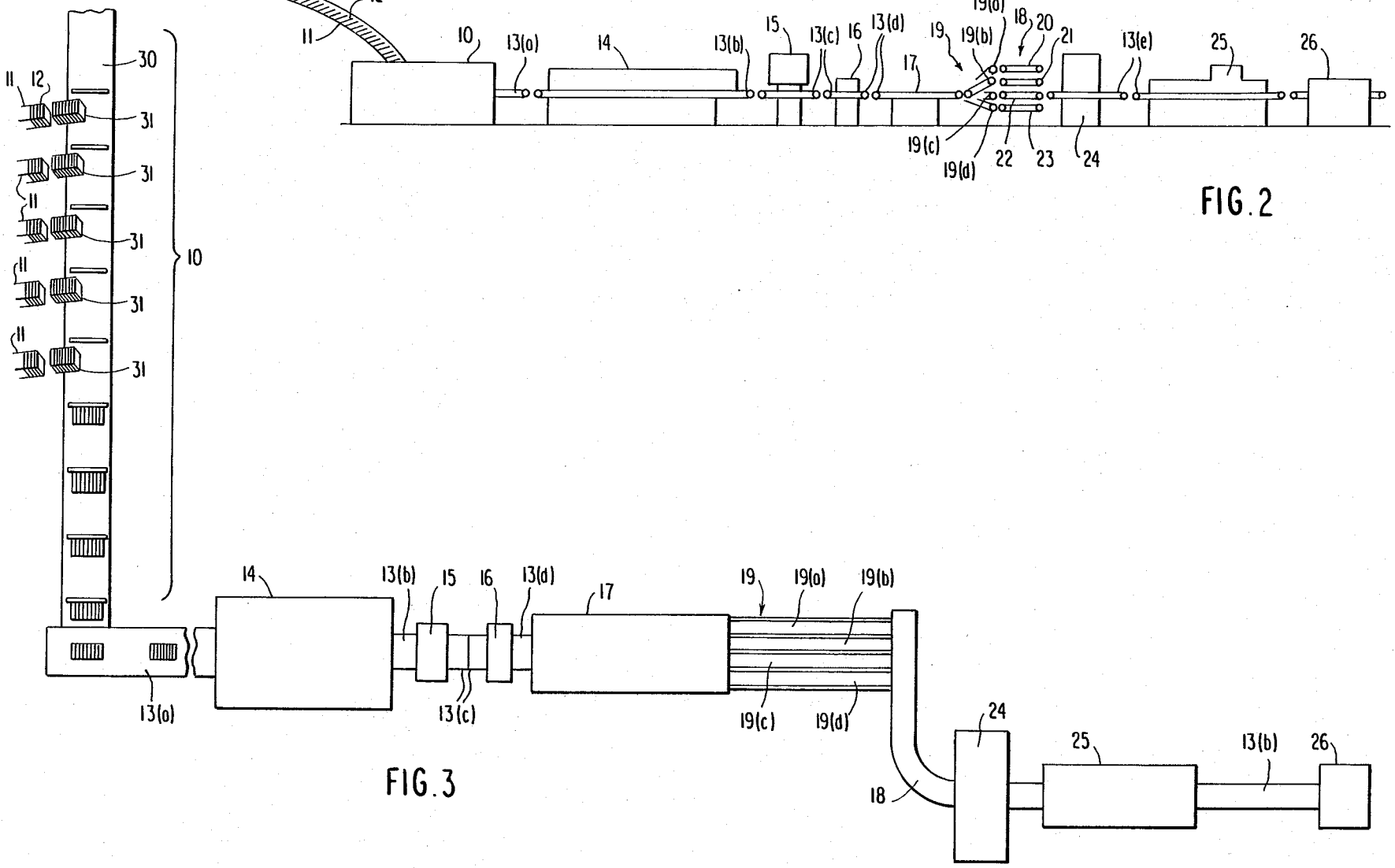
FIG. 3 is a general schematic plan view of the equipment used in the packaging system.

FIG. 3 shows the apparatus of FIG. 2 in a schematic plan view. Lanes 11 deliver articles 12, here shown to be biscuits, to conveyor 30. Five lanes are shown for illustrative purposes. Each length of articles 31 is delivered to conveyor 13(*a*) where they are delivered to wrapper 14. The wrapped articles, now in a slug pack form, go to checkweigher/classifier 15 and then to optional metal detector 16. The diverger 17 then directs the slug packs into different channels 20, 21, 22 or 23 of accumulator 18. Slug pack selector 24 will select slug packs from the accumulator channels according to weight and forward to cartoner 25. After the slug packs have been sealed in a carton, the filled carton is then optionally conveyed to the final checkweigher 26.

Figure 4:
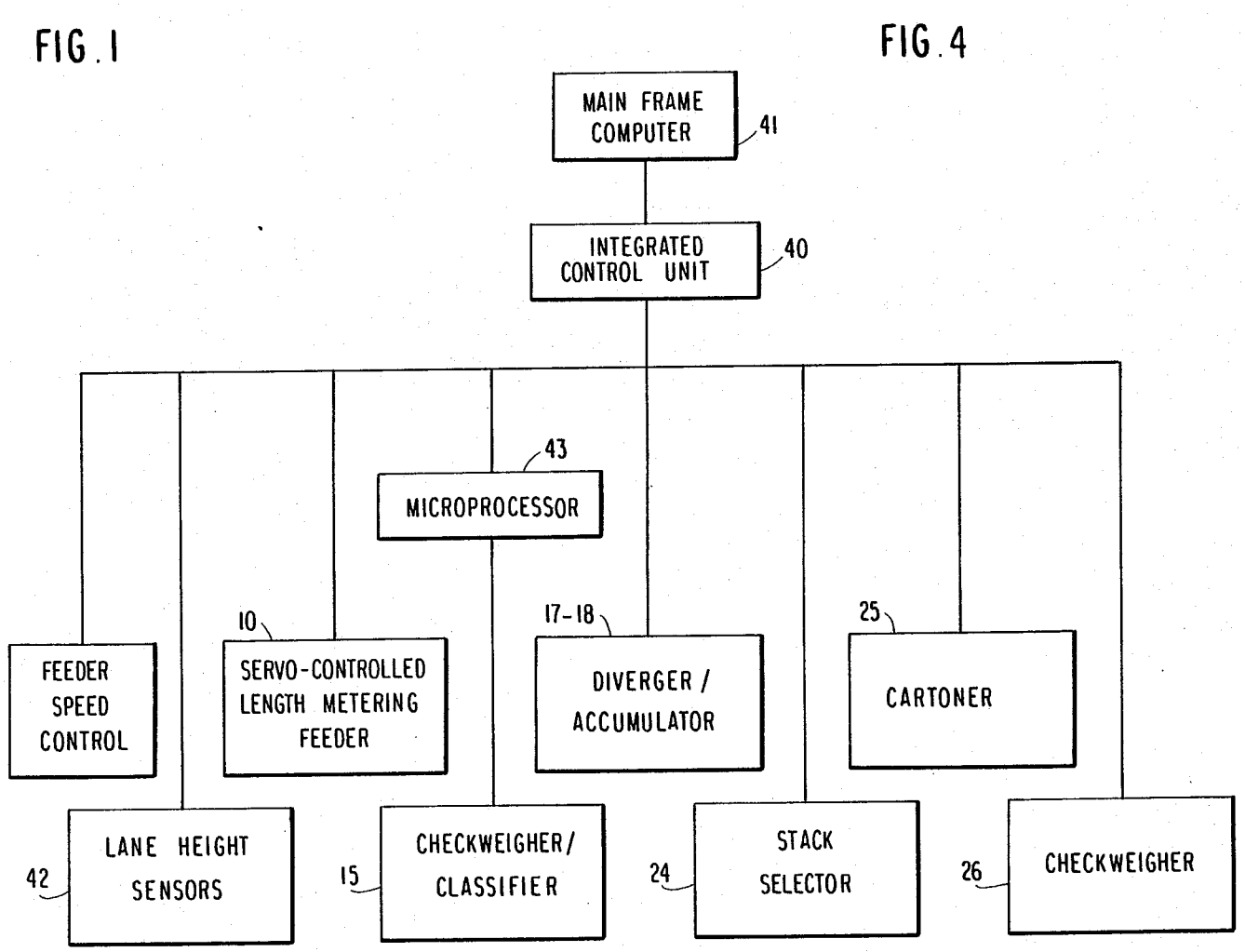
FIG. 4 is a schematic diagram of the packaging line control system.

FIG. 4 sets out a schematic diagram of the general computer integrated process control system for the apparatus of FIGS. 2 and 3. The principal controller for the array of equipment is the integrated control unit 40. The integrated control unit can also be connected into a mainframe computer 41. In such a case the mainframe computer stores various data concerning the process, but will in the usual case not be involved in the active control of the units of equipment. In FIG. 4 the lane height sensors 42, the Drive Control Feeder 39 and the servo-controlled length metering feeder 10 are the units of control for the length metering feeder of FIG. 1. The Drive Control Feeder controls the rate of feeding items such as crackers into the system. The lane height sensors are set to determine the shingled height of the articles that are to be wrapped. These articles are moving in a lane which is of a size similar to that of the article. A back pressure is maintained on the shingle arranged articles so that the articles are maintained in an orientation that is at an acceptable angle but less than 90° to the lane, and are thus maintained in a close touching contact. It is necessary that the articles be maintained at the proper angle approaching 90° for the servo-controlled feeder to select a given length of the articles for wrapping. The servo-controlled length metering feeder 10 does not select the items by number but rather by the length of articles in a given lane. Since the lane height sensors are preset, and since the stack angle of the units is monitored to keep it within the desired limits, there is an output from the lane height sensors to the integrated control unit, but no need for a signal from the integrated control unit back to the lane height sensors since these sensors are preset. If the lane height sensors for a given lane indicate that the preselected height is not being met, this information is sent to the integrated control unit. The integrated control unit will then select lengths of articles that are to be lower in weight from the lanes that have a low height and lengths of articles that are to be higher in weight from a lane that is high and tight. There is an overall bias to try to maintain the same number of articles in a slug pack and make adjustments only when required. Generally, the same number of articles is sent into each lane of the length metering feeder. The integrated control unit based on its preset programming would determine the course of action to be taken in each instance.

The servo-controlled length loader 10 is essentially a servo-controlled arm which extends into a lane and removes a certain length of articles from that lane. The articles are then conveyed to a wrapping unit. The length metering feeder unit is servo-controlled in a way that the length of articles removed can be controlled by the integrated control unit. The integrated control unit knows each length of articles that is being removed from each lane. If it is determined by the integrated control unit from data from the inventory control unit of the accumulator and other units that the length of articles that is sen for wrapping is either above or below a desired weight, the integrated control unit will adjust the servo on the arm which selects the length of articles to be wrapped and thus remove a shorter or a longer length of articles. Each lane will have a servo-controlled arm for removing a certain length of articles from a line. Each of these servo-controlled units is separately controllable.

Figure 5:
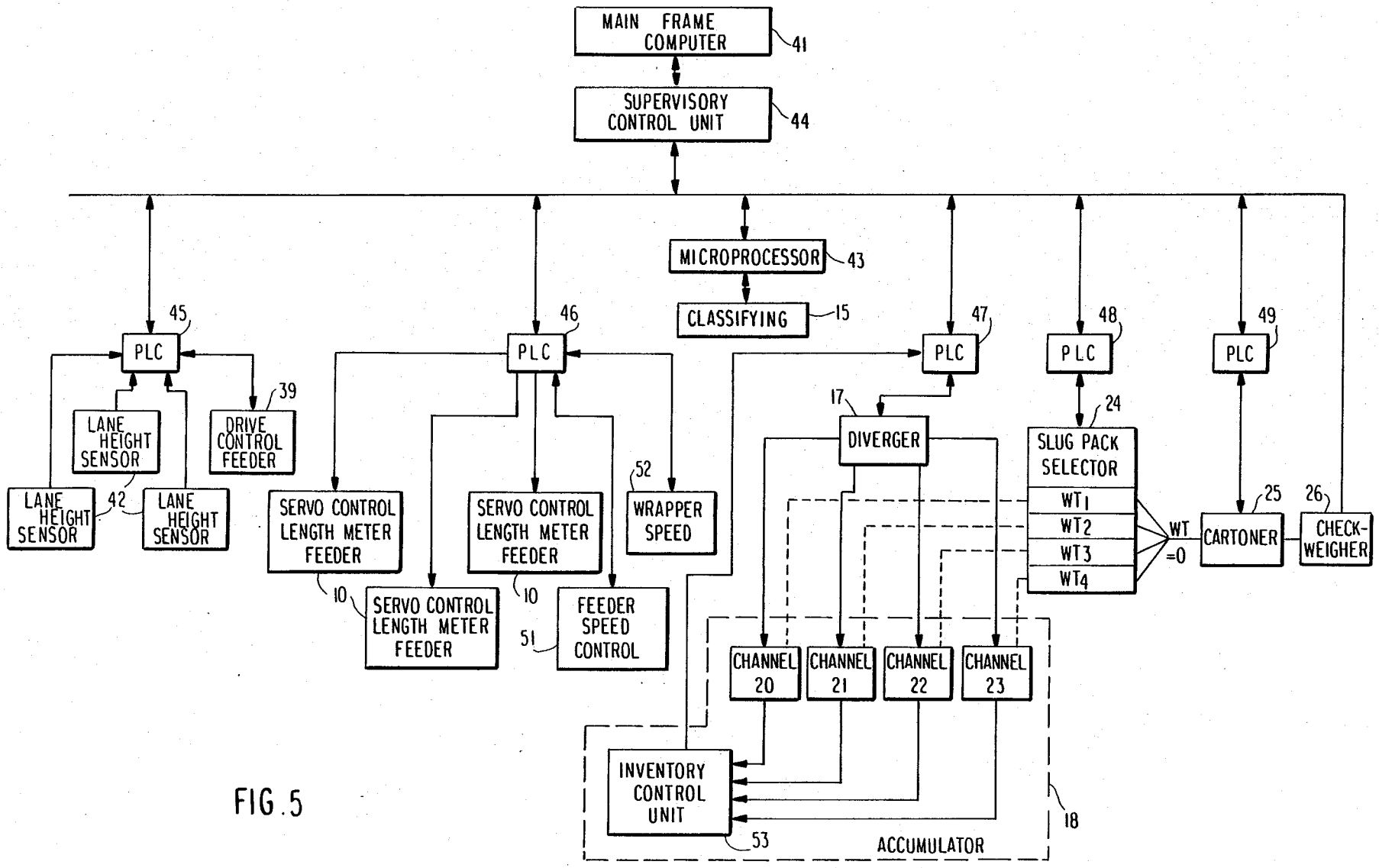
FIG. 5 is a schematic diagram of the packaging line control system of FIG. 4 in more detail.

The selected lengths of articles are conveyed to a wrapper and are wrapped using essentially any conventional wrapping apparatus and then conveyed to the weigh station. At the weigh station a checkweigher/classifier 15 will determine the weight of each slug pack and send this information to a microprocessor 43. This information is also forwarded to the integrated control unit. The slug pack is then sent by a conveyor to the diverger 17 and accumulator 18. The diverger is a unit that receives the weight information from the weigh station via the integrated control unit. The diverger conveys each slug pack to the proper accumulator channel. The accumulator is a multi-channel device for holding the inventory of classified stacks. That is, all slug packs will be classified and sorted into channels in the accumulator designated to receive slug packs with a certain number of overweight and underweight range categories. There can be any appropriate number of channels and weight classifications. As discussed above, the objective here is to sort out the slug packs in a logical fashion so that slug packs can be selected for final packaging or cartoning so as to reach a preselected final combined weight. The diverger delivers the slug packs to the accumulator channel as directed by the integrated control unit. Associated with the accumulator, and as illustrated in FIG. 5, is an inventory controller unit. The inventory controller unit maintains current information with regard to the number of slug packs within each accumulator channel. If the number of slug packs in any one accumulator channel is tending to become excessive or depleted, this information is conveyed to the integrated control unit and a signal is sent to the servo-controlled length metering feeder to adjust the length of articles that are being selected for wrapping. In this way the inventory of slug packs in the accumulator is maintained at a level so that the weight selector can choose slug packs that will result in a carton or a package within the target weight range. In this regard the accumulator is an important control point in the overall control system. Slug packs are then chosen by the slug pack selector 24 based on information received from the integrated control unit. The integrated control unit knows the weights of the slug packs in each accumulator channel and can thus mathematically make a choice such that the desired weight is met but not significantly exceeded. The selected slug packs are then sent to a cartoner and/or final packaging unit 25 where they are packaged for shipment for sale to the consumer. The information from the cartoner and an associated checkweigher 26 that would be sent to the integrated control unit would be information such as the final weight of the carton and the number of cartons that are filled in a given period of time.

The control system of FIG. 4 is set forth in more detail in FIG. 5. The integrated control unit 44 is shown in this figure to consist of the supervisory control unit 40 and programmable logic controllers 45, 46, 47, 48 and 49, designated as PLC. That is, the supervisory control unit and the programmable logic controllers constitute the integrated control unit in FIG. 4. The programmable logic controllers are dedicated to function with specific units of equipment. The supervisory control unit functions to control each of the PLC units. Each lane of the length metering feeder will require a height sensor unit. Three lane height sensor units are shown here for illustration purposes. In this figure the height sensor units 42 are shown feeding information to a programmable logic controller 45. This programmable logic controller gets a continuous input from the lane height sensors. It also gets an input from the feeder drive control unit 39 which supplies articles to each of the lanes of the length metering feeder. While the associated programmable logic controller only receives information from each of the height sensor units, it is able to provide a signal to and control the feeder drive control unit. The programmable logic controller also sends information to the supervisory control unit and receives information back from the supervisory control unit. One signal that could be received from the supervisory control unit back to the programmable logic controller of the height sensor unit would be a signal to vary the feed rate of the feed drive control unit and thus control the flow of articles into one of more lanes. The next controlled unit is the servo controlled length metering arms of the length metering feeder 10. Each lane of the length metering feeder will have a servo-controlled length meter feeder unit. Each of these servo-controlled length metering units receives a signal from a programmable logic controller 46 which receives an input from the supervisory control unit. The input from the progammable logic controller to each of the servo-controlled length metering feeders would be to either increase or to decrease the length of the articles that are being removed from a lane for feeding to the wrapper. The length metering speed controller 51 and the wrapper speed controller 52 are continuously adjusted so that there is an orderly continuous flow of selected lengths of articles to the wrapper. The length metering speed controller collectively controls the speed of operation of all of the servo-controlled length metering feeders. These length metering feeders cycle in unison in removing measured lengths of articles. The length metering speed controller regulates the cycling of the length metering feeders. From the wrapper the slug packs are conveyed to the weigh station which consists of a checkweigher/classifier 15 where each slug pack is weighed and this information used to determine the accumulator channel in which the slug pack is to be placed by the diverger. The diverger 17 is likewise controlled by a programmable logic controller. Based on the weigh information that the diverger receives from the supervisory control unit and through its programmable logic controller 47 each slug pack is directed to a particular accumulator channel. Each of the channels will contain slug packs that are within a given weight range. As shown here, and as previously shown, there are four accumulator channels. However there can be any number of channels.

The inventory control unit that is associated with the accumulator sends information to the programmable logic controller 47 with regard to the number of slug packs in each of the accumulator channels, and optionally of the rate of change of units in each accumulator channel. The integrated control unit also senses trends that are occurring in the weights of the slug packs and makes changes based on these trends. This keeps the system functioning at an optimal level. In the event that the inventory of slug packs in any one accumulator channel exceeds a certain number, or there is a trend in that direction, a signal is sent to supervisory control unit 44 that an adjustment will have to be made in the length of the articles that are being chosen to be wrapped by the servo-controlled length metering feeder. The supervisory control unit will then send a signal to the programmable logic controller 46 of the servo-controlled length metering feeder to adjust the length of articles put into the slug packs. The adjustment would be made in one or more lanes of the servo-controlled length metering feeder and the inventory of the slug packs in the accumulator channels would then automatically be adjusted to maintain the desired inventory level in each accumulator channel. The stack selector which has its own programmable logic controller 48, selects slug packs from the various accumulator channels in order to reach a minimum positive weight differential from the target weight. The weight data of the selected slug packs is then sent to the programmable logic controller 48 and then onto the integrated control unit. The cartoner 25 is controlled by a separate programmable logic controller 49 and also feeds information to the supervisory control unit. Information that would be sent to the supervisory control unit would be information such as the number of cartons filled within any given period of time. A final checkweigher 26 will determine the weight of the carton and this information can be sent to the supervisory control unit.

The programmable logic control units that are used are available from companies such as General Electric, the Allen Bradley Company, as well as others. The integrated control unit would be a unit such as those available from the IBM Corporation, the Digital Equipment, or Control Data Corporation. Suitable units are also available from many other sources. The integrated control unit will also usually have an associated printer and an associated keyboard for the input of the data. The mainframe computer would be of a kind that is found in any large business or manufacturing operation. Suitable mainframe computers are available from the IBM Corporation, Digital Equipment Corporation, Hewlett Packard or Control Data Corporation.

The units of computing equipment, like the units of the basic process equipment, are known in the art. The objective in the present instance is to provide for the optimum control over the process units of equipment. The objective is to accurately control the weight of the product which is delivered to the customer.

Other units of equipment can be added to the forgoing system as may be desired. For instance at certain points in the system it may be desirable to have information output channels. In this way the people controlling the system can visually get a readout as to any one part of the process. The data would be changing continuously and thus a person overseeing the process could continuously determine whether it is operating effectively. It would also be possible to integrate printers into the system at different points as well as to have audible alarms included.

What is claimed is:

1. A method for packaging discrete articles comprising:
(a) providing aligned lanes of articles;
(b) selecting measured lengths of such articles;
(c) feeding said measured lengths of articles to a wrapping station;
(d) wrapping said measured length of articles to form slug packs of wrapped articles;
(e) determining the weight of each slug pack of wrapped articles;
(f) classifying and channeling the slug packs of wrapped articles by weight categories; and
(g) selecting a number of slug packs that have a combined weight within a desired weight range and placing the selected slug packs in a package.

2. A method for packaging discrete articles as in claim 1 wherein the measured lengths of articles to be wrapped can be adjusted to produce wrapped slug packs of articles that have differing weights sufficient when combined with other wrapped slug packs to yield the combined weight within the desired weight range.

3. A method for packaging discrete articles as in claim 2 wherein the weight of each slug pack is recorded and the recorded weight used in classifying and channeling the slug packs and in selecting a set number of slug packs for packaging.

4. A method for packaging discrete articles as in claim 2 wherein the number of slug packs that are classified and channeled by weight is determined for each weight category.

5. A method for packaging discrete articles as in claim 4 wherein when a weight category of slug packs is deficient in the number of slug packs, the measured length of articles that is chosen to be wrapped is adjusted to increase the number of slug packs in the deficient category.

6. A method for packaging discrete articles as in claim 4 wherein when a weight category of slug packs has an excess of slug packs the measured length of articles that is chosen to be wrapped is adjusted to decrease the number of slug packs in the excess category.

7. A method for packaging discrete articles as in claim 1, comprising maintaining a back pressure on said lane of articles.

8. A method for packaging discrete articles as in claim 1 wherein at least two slug packs are selected to be packaged.

9. A method for packaging discrete articles as in claim 1 wherein said discrete articles are food items.

10. A method for packaging discrete articles as in claim 9 wherein said food items are crackers.

11. A method for packaging discrete articles as in claim 9 wherein said food items are cookies.

12. A method for packaging discrete articles as in claim 9 wherein said food items are biscuits.

13. A method for packaging discrete articles comprising:
(a) providing aligned lanes of articles;
(b) monitoring the orientation of each aligned lane of articles;
(c) selecting measured lengths of such articles based on information received from an integrated control unit;
(d) wrapping said measured lengths of articles to form slug packs of wrapped articles;
(e) determining the weight of each slug pack and providing such information to said integrated control unit;
(f) classifying and channeling the slug packs by weight categories based on information received from said integrated control unit;
(g) determining the inventory of said slug packs in each weight category and providing such information to said integrated control unit;
(h) selecting a number of slug packs based on information from said integrated control unit and placing the same in a final package to produce a package within a desired weight range.

14. A method for packaging discrete articles as in claim 13 wherein the measured lengths of articles which are selected are adjusted using information provided by the integrated control unit based on the weight of the slug packs in each weight category and the number of slug packs in each weight category.

15. A method for packaging discrete articles as in claim 14 wherein said integrated control unit monitors the orientation of said aligned lanes of articles and controls the rate of selecting said measured lengths of articles.

16. A system for packaging discrete articles comprising:
(a) a feeding means having a multiple number of lanes to hold and convey articles to be wrapped;
(b) metering feeder means to select a measured length of such articles to be wrapped from said stacking means;
(c) conveying means to deliver such articles to be wrapped to a wrapper;
(d) means to wrap the delivered articles to form slug packs of wrapped articles;
(e) weighing means to determine the weight of each slug pack conveyed from said wrapper;
(f) means to direct the weighed slug packs into separate channels of an accumulator based on the weight of each slug pack;
(g) means to select a plurality of slug packs from the channels of said accumulator such that the plurality of slug packs selected is within a desired combined weight range; and
(h) means to combine the selected slug packs into a package.

17. A system for packaging discrete articles as in claim 16 comprising means to record the weight of each slug pack.

18. A system for packaging discrete articles as in claim 17 comprising means to send a signal based on the recorded weight of each slug pack to said means to direct the slug packs to selected channels so that each slug pack is directed to an accumulator channel based on the weight of said slug packs.

19. A system for packaging discrete articles as in claim 18 comprising means to continuously record the number of slug packs in each accumulator channel.

20. A system for packaging discrete articles as in claim 19 comprising means to adjust the measured length of articles to be wrapped based on the number of slug packs in each accumulator channel.

21. A system for packaging discrete articles as in claim 20 comprising means to record the weight of each slug pack that is chosen to be packaged.

22. A system for packaging discrete articles as in claim 21 comprising means to record the weight of each package of slug packs and the number of such packages filled in a period of time.

23. A system for packaging discrete articles as in claim 16 wherein said feeding means has means to monitor the orientation of said articles and to maintain a back pressure on said articles to be packaged in a designated orientation.

24. A system for packaging discrete articles as in claim 16 wherein said metering means has means to adjust the measured length of articles to be wrapped based on information on the weight of slug packs and the number of slug packs in said accumulator channels.

25. A system for packaging discrete articles as in claim 16 comprising an integrated control unit which receives information signals from means units of said system and sends control signals to means units of said system.

26. A system for packaging discrete articles as in claim 25 comprising means to convey information signals from said weighing means unit and from said accumulator to said integrated control unit.

27. A system for packaging discrete articles as in claim 26 comprising means to convey information signals from said feeding means unit and said metering means unit to said integrated control unit.

28. A system for packaging discrete articles as in claim 27 comprising means to convey information signals from said means unit to select a plurality of slug packs and said means unit to combine the selected slug packs into a package to said integrated control unit.

29. A system for packaging discrete articles as in claim 25 comprising means to send control signals from said integrated control unit to means units of said system.

30. A system for packaging discrete articles as in claim 29 comprising means for said integrated control unit to send control signals to said metering means unit.

31. A system for packaging discrete articles as in claim 30 comprising means for said integrated control unit to send control signals to said means unit to direct slug packs to accumulator channels.

32. A system for packaging discrete articles as in claim 31 comprising means to send control signals to said means unit to select a plurality of slug packs.

* * * * *